United States Patent [19]

Spindeler et al.

[11] Patent Number: 4,491,505

[45] Date of Patent: Jan. 1, 1985

[54] APPARATUS FOR LEVELING COAL IN A COKE OVEN CHAMBER

[75] Inventors: Heinrich Spindeler; Folkard Wackerbarth, both of Bochum, Fed. Rep. of Germany

[73] Assignee: Dr. C. Otto & Comp. G.m.b.H., Bochum, Fed. Rep. of Germany

[21] Appl. No.: 558,021

[22] Filed: Dec. 5, 1983

[30] Foreign Application Priority Data

Dec. 9, 1982 [DE] Fed. Rep. of Germany ..... 3245552

[51] Int. Cl.[3] ..... C10B 29/02; C10B 37/02

[52] U.S. Cl. ..... 202/270; 201/40; 414/587

[58] Field of Search ..... 202/239, 262, 270, 139; 201/40; 414/587, 588

[56] References Cited

U.S. PATENT DOCUMENTS

| | | | |
|---|---|---|---|
| 1,979,419 | 11/1934 | Still | 414/587 |
| 4,181,578 | 1/1980 | Stauffer et al. | 202/270 |

FOREIGN PATENT DOCUMENTS

| | | | |
|---|---|---|---|
| 294009 | 9/1916 | Fed. Rep. of Germany | 202/139 |
| 1110134 | 7/1961 | Fed. Rep. of Germany | 202/270 |
| 2831460 | 1/1980 | Fed. Rep. of Germany | 201/40 |

*Primary Examiner*—Bradley Garris

*Attorney, Agent, or Firm*—Thomas H. Murray; Clifford A. Poff

[57] ABSTRACT

A coal-leveling apparatus includes a leveling rod supported by a pressing machine for movement through a leveling opening into a mushroom-shaped gas-collecting space to level the coal charged in the coking chamber of a coke oven. The leveling rod includes a head element that carries two support members that can move on pivot levers between an operative position wherein the support members are extended from the head element for support by upwardly-inclined wall surfaces in the mushroom-shaped gas-collecting space. In the inoperative position, the support members are retracted toward both sides of the head element. An actuating rod extends through the leveling rod to the head element. In one embodiment, the actuating rod can be moved in opposite directions of its length. An end of each of the first pivot levers is connected to the actuating rod and the opposite ends of the first levers are connected to second pivot levers. The second pivot levers are connected at one end to the head element and carry the support members. The connection between the pivot levers and the actuating rod, in one embodiment, is by a pivot connection, and in another embodiment by rollers that can move along an inclined surface on an end of the actuating rod. In a third embodiment a nut is threadedly engaged with threads on the end portion of the actuating rod to move the levers.

10 Claims, 8 Drawing Figures

APPARATUS FOR LEVELING COAL IN A COKE OVEN CHAMBER

BACKGROUND OF THE INVENTION

This invention relates to apparatus for leveling the coal which is charged into a coking chamber of a coke oven and, more particularly, to such apparatus which includes a leveling rod which is introduced through the opening that is normally closed by a leveling door from a pressing machine into a gas-collecting space of the coking chamber where the leveling rod is reciprocated to level the coal charge and then withdrawn from the gas-collecting space after completion of the leveling operation.

The development of high-performance coke ovens having coking chambers which, in some instances, are greater than 6 meters high have brought about limitations to the construction of these taller coking chambers. A variant for the high-perfomance coking ovens which can be satisfactorily developed is the so-called long ovens wherein the coking chambers are longer than coking chambers in conventional coke ovens. In the long coke oven chambers, a problem arises in connection with the leveling operation for the coal which is introduced into the coking chambers. These problems are due to the deflection or sagging of the leveling rod which is introduced conventionally from the coke machine side. The leveling rod must be adapted to the length of the coking chambers. One attempt to alleviate this disadvantage was to carry out the leveling operation from both sides of a coking chamber. However, this requires a substantial increase in costs since the leveling rod and the associated drive facilities must be provided at both the machine side and the coke side of an oven chamber. This has been found to be an unsatisfactory solution to the problem, particularly in the confined spaces of a coke oven plan.

SUMMARY OF THE INVENTION

It is an object of the present invention to provide a leveling apparatus wherein sag of a leveling rod used for leveling the coal charged into the oven chamber does not exceed a predetermined amount even when the length of the leveling rod is adapted to coke oven chambers having an extended length.

According to the present invention, there is provided a coal-leveling apparatus including a leveling rod having a front or head element on the front end thereof which is constructed with substantially the same cross-sectional dimensions as the leveling rod. Two support members are carried by pivot levers on the head element for pivotal movement from a pressing machine by an actuating means between an inoperative position wherein the support members are disposed in the head element and an operative position wherein the support members extend from opposite sides of the head element immediately above wall portions which extend in an inclined manner upwardly and outwardly. The wall portions are extensions of two heating walls bounding the coking chamber and bound a mushroom-shaped gas-collecting space.

According to a further feature of the present invention, the aforementioned actuating means includes an actuating rod extending inside the leveling rod and displaceable in opposite directions of its length and relative to the leveling rod. In the further embodiment, the actuating rod is rotatable in opposite directions about an axis extending along the length thereof relative to the leveling rod. The actuating rod is connected to pivot levers for extending and retracting the support members from the head element. The support members may take the form of shoes that can slide along the wall portions in the mushroom-shaped gas-collecting space or rollers that can move along such wall portions. It has been found convenient to provide that the pivot levers to which the support members are secured are displaced through an angle such that the support surfaces of the support members extend substantially parallel to the surfaces of the inclined wall portions.

Preferably, the actuating means for extending and retracting the support members from the head element includes a pivot secured to and movable with the actuating rod. A first pivot rod is connected at one end to the pivot and a second pivot rod has one end pivotally connected to the first pivot rod. The opposite end of the second pivot rod is pivotally connected to a pivot which is fixedly mounted or supported on the head element. An arm extending diagonally downward carries the support member at its one end while the opposite end is secured to the second pivot rod. The support members are moved into an extended or operative position from the head element when the actuating rod is moved to the rear, i.e., in a direction toward the leveling rod. In the operative position, the support members are disposed above the inclined wall portions in the gas-collecting space. When the actuating rod is moved forwardly, the support members are retracted into a position wherein the support members are closely adjacent the head element.

According to a further feature of the present invention, the actuating means for extending and retracting the support members on the head element takes the form of two levers each having two arms that extend at an angle to one another. Each lever is pivotally supported by a horizontal shaft extending generally parallel to the actuating rod and disposed on the head element. A support member is carried at an end of one arm. A roller on the end of the other arm moves along a path formed by an inclined plane disposed near the head element on the underside of the actuating rod which is movable relative to the head element. Conveniently, in this embodiment, the actuating rod in a region near the head element takes the form of a forwardly-descending diagonal plane whereby the rollers on the ends of the arms are at a lower level than in the preceding position. The support members are in an extended or operative position when the rollers are at the front end of the actuating rod. The support members are retracted in a downward direction when the actuating rod is moved forwardly.

According to a further feature of the present invention, the front end of the actuating rod takes the form of a spindle on which a spindle nut is threadedly engaged. Pivot rods for moving the support members between operative and inoperative positions are pivotally connected to the spindle nut. The support members are movable in a dependent relation upon the direction of rotation by the spindle which moves the spindle nut either into a first position where the support members are retracted into an inoperative position or when the nut is moved into a rear position, the support members are extended from the head element into an operative position.

Thus, it can be seen that the present invention prevents dropping of the front end of the leveling rod by providing support members which can be extended and retracted from the head element on the rod to movably support the rod on the inclined surfaces in the gas-collecting space when the rod starts to sag. This position of the support members is retained throughout the leveling operation such that the rod can be used for very long ovens. It is to be understood, however, that the leveling rod can be provided with further appropriate support in a central region should this prove necessary or desirable.

These features and advantages of the present invention as well as others will be more fully understood when the following description is read in light of the accompanying drawings, in which.

Figure 1:
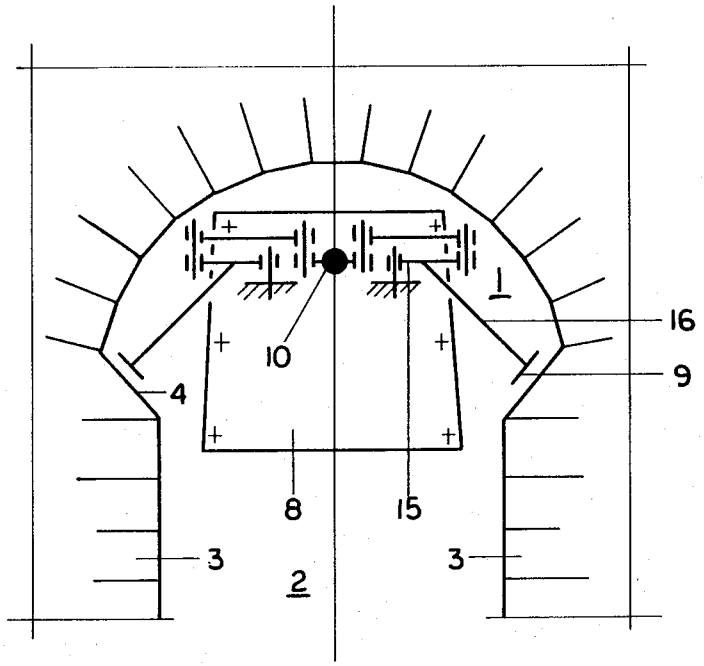
FIG. 1 is a front elevational view of a leveling apparatus in a gas-collecting space above a coke oven chamber.
Figure 3:
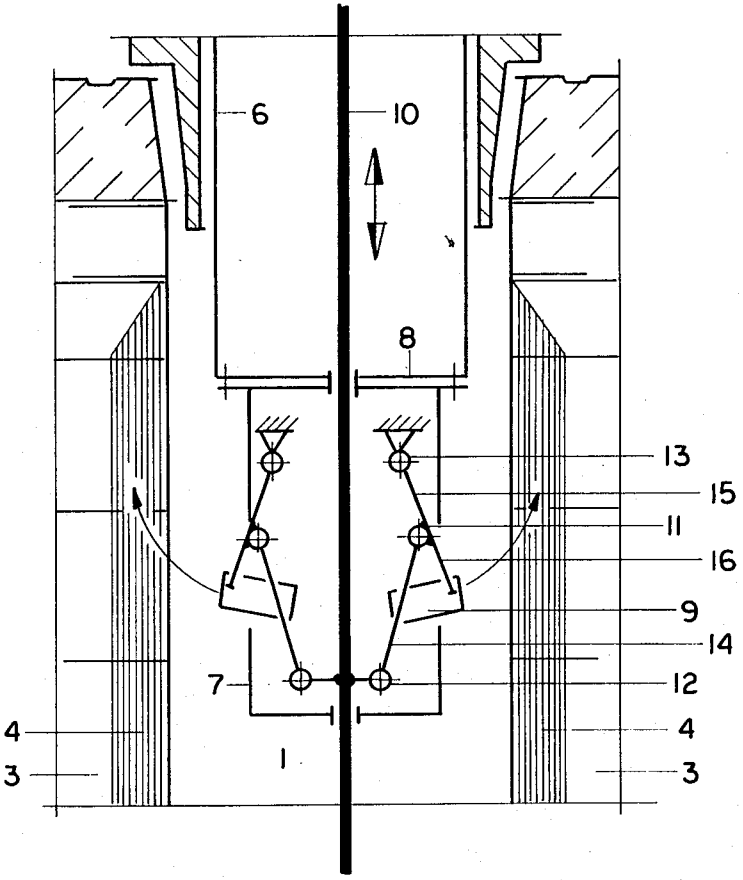
FIG. 3 is a plan view of the leveling apparatus similar to FIG. 1 but illustrating the support members in a retracted position.
Figure 2:
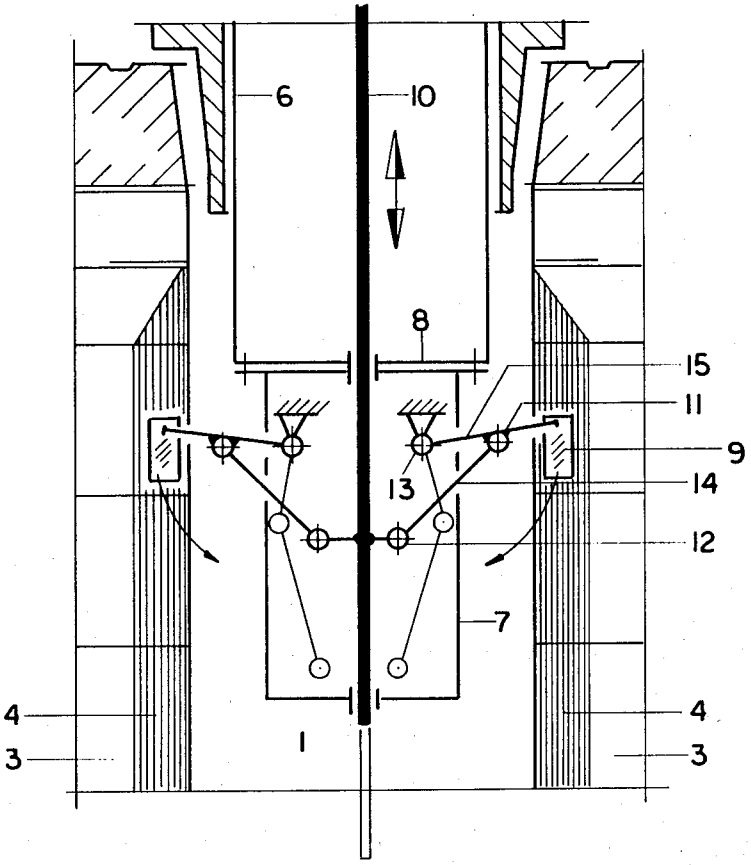
FIG. 2 is a plan view of the apparatus shown in FIG. 1 in which support members are extended from the apparatus for support by wall portions in the gas-collecting space.

In FIG. 1, reference numeral 1 identifies a mushroom-shaped gas-collecting space in the top part of a coking chamber 2 which is bounded by heating walls 3. The heating walls 3 are extended by wall portions 4 that extend diagonally, in an upward and outward manner, and merge with an arch or vault forming the gas-collecting space 1. The arch has the form of a partial circle whose diameter is greater than the internal width of the coking chamber 2. In FIGS. 1–3, reference numeral 6 identifies a leveling rod which embodies a conventional construction known in the art. The leveling rod is introduced into the space 1 through a leveling opening that is normally closed by a leveling door which may be supported by a removable door forming an enclosure for the coke oven chamber. A front or head element 7 is secured by a plate 8 on the front end of the leveling rod. The head element includes pivots and levers for extending and retracting two support members 9 which, when extended, can engage surfaces on both sides of the wall portions 4 and slide therealong. The levers in the head element are actuated by means of an actuating rod 10 which can move relative to the leveling rod 6 and extends through the interior of the rod from the pressing machine into the head element.

In the embodiment of the present invention shown in FIGS. 1–3, the actuating mechanism for extending and retracting the support members 9 includes two pivots or articulations 11 and 12 that are movable with rod 10. A pivot 13 is rigidly secured to the head element 7. The present invention provides horizontal pivot rods that are pivotal about vertical shafts. A first pivot rod 14 is connected at one end by pivot 12 to the actuating rod 10. The free end of pivot rod 14 can pivot around the pivot 11 to which there is pivotally secured a second pivot rod 15. One end of pivot rod 15 is attached by the stationary pivot 13 to the head element as shown in FIG. 1 and extends in an inclined manner downwardly from the horizontal pivot rod 15 whereby the support members 9 are in an extended position and are disposed in a confronting, generally parallel relation with the surfaces of wall portions 4. It is to be understood, of course, that the pivots and pivot rods as described previously are provided at each side of the head element for carrying the two support members 9.

In FIG. 2, the support members are shown in an extended position from the head element wherein the support members are situated near the inclined wall portions 4. The phantom-line position of the pivots and pivot rods in FIG. 2 illustrates the position of these parts when the support members are in a retracted or an inoperative position. This position is shown in FIG. 3 wherein the leveling rod with the head element can be moved through the leveling opening at the end of the gas-collecting space.

Figure 4:
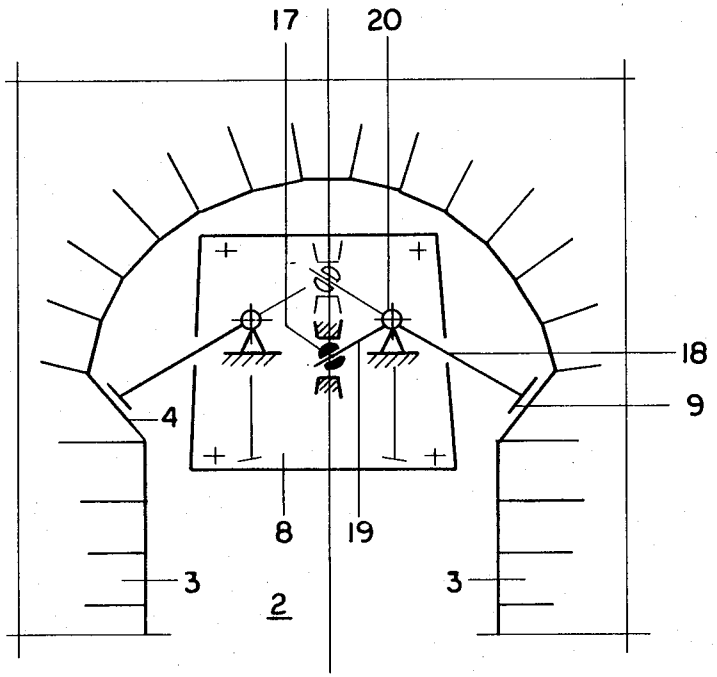
FIG. 4 is a view similar to FIG. 1 but illustrating a second embodiment of the leveling apparatus of the present invention.
Figure 6:
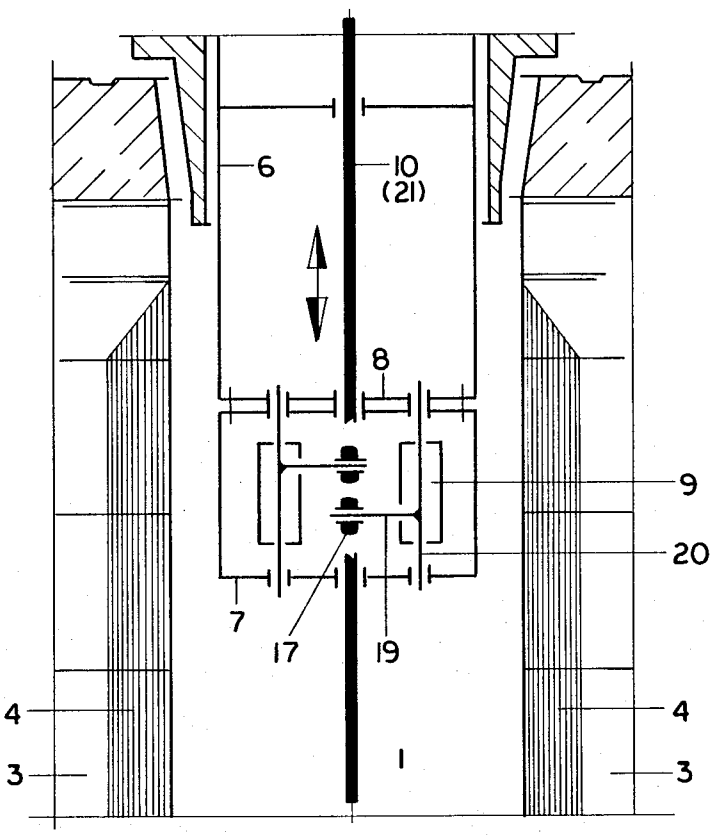
FIG. 6 is a plan view similar to FIG. 3 but illustrating the embodiment of the apparatus shown in FIG. 4.
Figure 5:
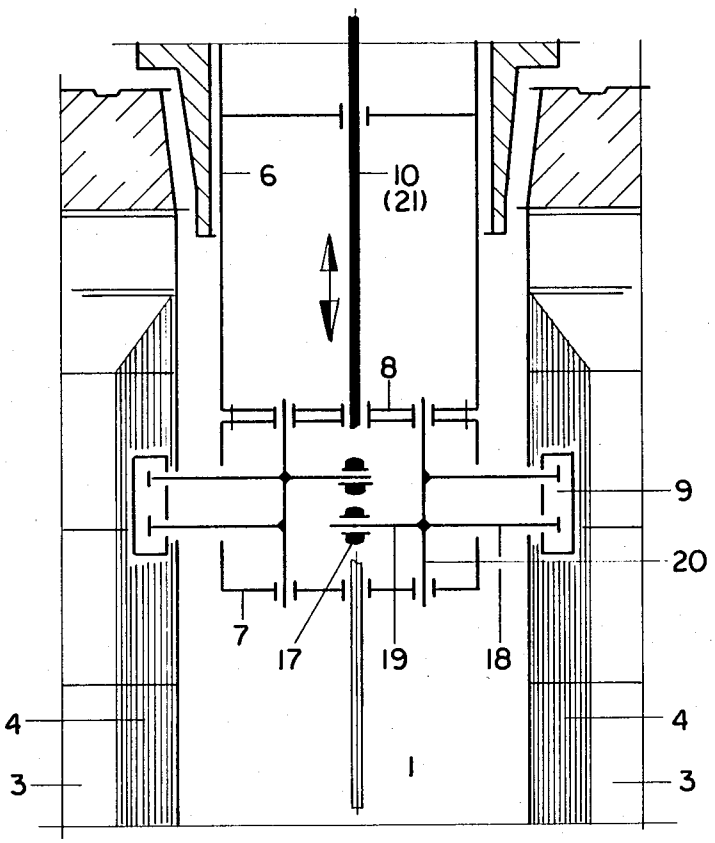
FIG. 5 is a plan view corresponding to FIG. 2 but illustrating the arrangement of the apparatus shown in FIG. 4.

A second embodiment of the present invention is shown in FIGS. 4–6. In this embodiment, the actuating mechanism includes a diagonal or inclined plane from the front portion of actuating rod 10. The inclined plane descends forwardly, i.e., toward the end of the rod 10, and serves as a path or guide surface for a roller 17 that is provided on the ends of lever arms 19. The lever arms 19 are part of two pivot levers each having two lever arms that are bent downwardly as shown in FIG. 4. The support member 9 is disposed on the end of an outer lever arm 18 and the roller 17 is disposed on the end of lever arm 19. A horizontal shaft 20 which extends parallel to the actuating rod 10 forms a fulcrum about which the levers having lever arms 18 and 19 can pivot. The support members 9 are moved into the extended or operative position, shown in FIGS. 4 and 5, when the rollers 17 are at the lowest end position 21 formed by the inclined surface on actuating rod 10. As shown in FIG. 6 and by the phantom-line position in FIG. 4, the support members 9 are moved into a retracted or inoperative position by a downward pivotal movement which occurs by moving the actuating rod 10 forwardly such that the rollers 17 move along the inclined position to the highestelevation. Preferably, as shown in FIG. 4, the inclined plane on the underside of end portion 21 of the rod 10 takes the formof a slot or an elongated aperture to form positive guiding such that the support members can be retracted even though coal may be deposited in the region of the various pivots.

Figure 8:
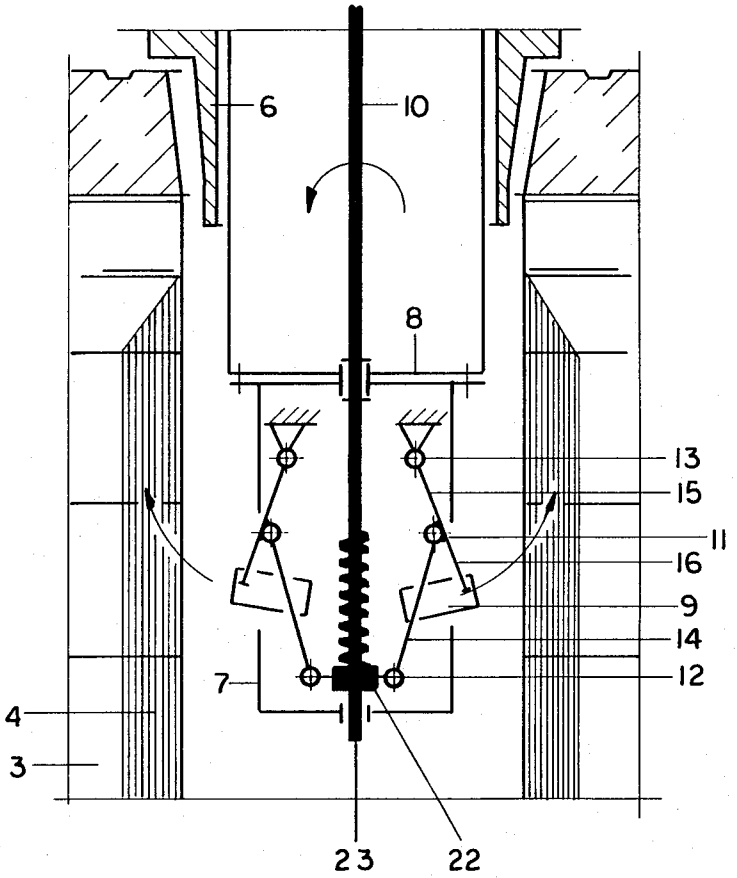
FIG. 8 is a plan view similar to FIG. 3 but illustrating the embodiment of the present invention shown in FIG. 7.
Figure 7:
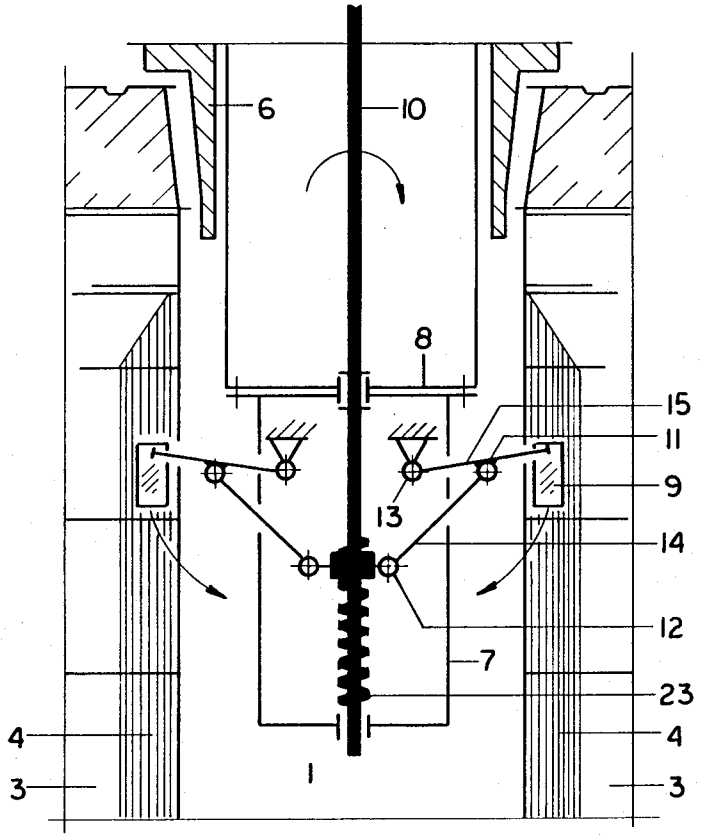
FIG. 7 is a plan view similar to FIG. 2 but illustrating a third embodiment of the present invention.

The embodiment of the present invention shown in FIGS. 7 and 8 differs from the embodiments described hereinbefore by the provision that the actuating rod 10 is mounted for rotation about an axis extending along the length of the rod rather than for longitudinal movement. The pivots and pivot levers are secured and arranged in the same manner shown in FIGS. 2 and 3 and described previously. However, pivots 12, instead of being secured in a fixed manner to the actuating rod 10, are connected to a spindle nut 22 which is engaged with threads of a spindle 23 formed on the front end of the actuating rod 10. The spindle nut moves forwardly or backwardly, i.e., in opposite directions, according to the direction of rotation of the spindle. Rotation of the spindle in one direction moves the support members 9 into a retracted or inoperative position shown in FIG. 8. Rotation of the spindle in the opposite direction moves the support members 9 into an extended or operative position shown in FIG. 7.

The coal-leveling apparatus of the present invention operates by providing that at the start of the leveling operation, the head portion of the leveling rod is introduced from the pressing machine side through the leveling opening into the oven chamber with the support members 9 in a retracted position as shown in FIGS. 3 and 6. After passing through the leveling opening, the actuating rod 10 is pushed rearwardly toward the pressing machine or, according to the embodiment shown in FIGS. 7 and 8, the actuating rod is rotated such that the arms to which the support members are secured extend from the head element 7 and move into an operative position shown in FIGS. 1, 2, 4 and 5. In the operative position, the support members are disposed, in a confronting relation, a short distance above the inclined surfaces of wall portions 4. The actuating rod is moved in the direction of its length by either stopping advancing movement of the leveling rod for a brief time during which the actuating rod is drawn in a rearward direction or the actuating rod can be stopped briefly while the leveling rod advances to penetrate further into the coking chamber until the pivot arms move into an extended position, thereby moving the support members into an operative position. In the event the leveling rod sags or deflects while moving further into the coking chamber or during reciprocating movement therein, the support members engage with the inclined wall portions 4 and slide thereon, thus preventing any further sag or deflecion of the leveling rod. When the leveling rod is retracted, the support members are retracted into an inoperative position. This is carried out by a forward movement of the actuating rod or by rotation of the actuating rod in the direction which is opposite the direction which the rod was rotated to extend the support members. In the inoperative position of the support members, the leveling rod can be moved into an inoperative position on the pressing machine.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A coal-leveling apparatus including a leveling rod in combination with a coking chamber of a coke oven, a door for said coking chamber, said door including a leveling door normally closing a leveling opening in the door, a pressing machine for supporting said leveling rod for leveling the coal charged into said coking chamber, said coking chamber being bounded by two heating walls and wall portions extending in an upwardly- and outwardly-inclined manner from said heating walls for forming part of a mushroom-shaped gas-collecting space in a top portion of the coking chamber, said coal-leveling apparatus being arranged for introducing said leveling rod through the opening normally closed by said leveling door from the pressing machine into said mushroom-shaped gas-collecting space of the coking chamber for reciprocating the rod in said space and withdrawal of the leveling rod after leveling the coal charge in the coking chamber, said leveling apparatus further including a head element on a front end portion of said leveling rod and having substantially the same cross-sectional dimensions as the leveling rod, two support members carried by pivot levers on said head element, and actuating means for pivoting said support members from the pressing machine between an inoperative position wherein the support members are disposed in said head element and an operative position wherein said support members are extended from opposite sides of the head element immediately above said wall portions which form boundaries of said mushroom-shaped gas-collecting space.

2. The coal-leveling apparatus according to claim 1 wherein said actuating means includes an actuating rod extending inside said leveling rod for displacement in opposite directions of the length thereof relative to said leveling rod, said actuating rod being connected to said pivot levers for pivoting said support members between the operative and inoperative positions for extending and retracting the support members relative to said head element.

3. The coal-leveling apparatus according to claim 1 wherein said actuating means includes an actuating rod extending inside said leveling rod for rotation in opposite directions relative to the leveling rod, said actuating rod being connected to said pivot levers for pivoting said support members between the operative and inoperative positions for extending and retracting, respectively, the support members relative to the head element.

4. The coal-leveling apparatus according to claim 1 wherein said support members include shoes adapted to slide along said wall portions extending in an upwardly- and outwardly-inclined manner from the heating walls.

5. The coal-leveling apparatus according to claim 1 wherein said support members include rollers.

6. The coal-leveling apparatus according to claim 1 wherein said pivot levers are connected to position said support members such that the support surfaces of the support members extend substantially parallel to the wall portions which extend in an upwardly- and outwardly-inclined manner from the heating walls in the mushroom-shaped gas-collecting space.

7. The coal-leveling apparatus according to claim 1 wherein said actuating means includes an actuating rod having a pivot on said actuating rod, a first pivot rod connected by said pivot to said actuating rod, a second pivot rod having one end pivotally connected to the first pivot rod and the other end connected by a pivot to said head element, and an arm secured at one end to said support member and secured at the opposite end thereof to said second pivot rod, said support members being displaced by movement of said actuating rod rearwardly toward the leveling rod in which the support members are disposed above said wall portions, said support members being displaced by movement of the actuating rod to a position near the head element by movement of the actuating rod into a forward position.

8. The coal-leveling apparatus according to claim 1 wherein said actuating means includes an actuating rod wih a lever having two arms extending at an angle to one another, said lever being supported by a shaft extending generally parallel to said actuating rod and disposed on said head element, one of said support members being disposed on one end of one of said arms and the other of said arms having a roller on its opposite ends, said actuating rod having an inclined plane along which said roller can move relative to said head element.

9. The coal-leveling apparatus according to claim 8 wherein said actuating rod includes a region near said head element wherein said inclined plane descends forwardly along a diagonally-extending plane such that said rollers on the end of said actuating rod force the support members to retract downwardly toward the head element as the actuating rod moves forwardly from the head element.

10. The coal-leveling apparatus according to claim 1 wherein said actuating means comprises an actuating rod having a spindle on a front end portion thereof located generally within said head element, a spindle nut on said spindle, pivot rods pivotally connected to said nut for extending and retracting said support members, said support members being movable between the operative and inoperative positions thereof by rotation of said spindle.

* * * * *

UNITED STATES PATENT OFFICE

CERTIFICATE OF CORRECTION

Patent No. 4,491,505 Dated January 1, 1985

Inventor(s) Heinrich Spindeler et al

It is certified that error appears in the above-identified patent and that said Letters Patent are hereby corrected as shown below:

on the title page in item [75] add:

--Horst Althous--

Signed and Sealed this

Ninth Day of July 1985

[SEAL]

*Attest:*

DONALD J. QUIGG

*Attesting Officer* *Acting Commissioner of Patents and Trademarks*